United States Patent [19]

Ackerman

[11] Patent Number: 4,543,278

[45] Date of Patent: Sep. 24, 1985

[54] TOY DISPLAY WALL HANGING

[76] Inventor: Gordon K. Ackerman, 101 Prospect St., Little Falls, N.Y. 13365

[21] Appl. No.: 638,261

[22] Filed: Aug. 6, 1984

[51] Int. Cl.[4] ..... A41G 1/00; B44C 5/04

[52] U.S. Cl. ..... 428/18; D11/118; 248/205.2; 428/100; 428/913.3

[58] Field of Search ..... 428/18, 19, 100, 913.3; 248/205.2, DIG. 13, 205.2; 52/DIG. 13; 273/DIG. 30; D11/118, 131, 132, 135, 139

[56] References Cited

U.S. PATENT DOCUMENTS

| | | | |
|---|---|---|---|
| 2,078,022 | 4/1937 | Roemer | 446/227 |
| 2,577,270 | 12/1951 | Riley | 428/913.3 X |
| 2,615,583 | 10/1952 | Johnson | D11/118 X |
| 3,316,669 | 5/1967 | Nachbar | 428/100 X |
| 3,327,419 | 6/1967 | Stanos | 428/100 X |
| 3,370,818 | 2/1968 | Perr | 428/100 X |
| 3,564,732 | 2/1971 | Lynd | 428/18 X |
| 3,784,201 | 1/1974 | Wyman et al. | 273/DIG. 30 |
| 3,789,547 | 2/1974 | Chemarin | 428/100 X |
| 4,106,228 | 8/1978 | Gibrich | D11/118 X |
| 4,240,639 | 12/1980 | Bolton et al. | 428/11 X |
| 4,287,530 | 6/1983 | Miller | 428/16 X |
| 4,435,452 | 3/1984 | Hernandez et al. | 428/913.3 X |
| 4,452,362 | 6/1984 | Mancin | 428/100 X |

FOREIGN PATENT DOCUMENTS

| | | | |
|---|---|---|---|
| 2032785 | 5/1980 | United Kingdom | 273/DIG. 30 |

*Primary Examiner*—Henry F. Epstein

*Attorney, Agent, or Firm*—Walter F. Wessendorf, Jr.

[57] ABSTRACT

Disclosed is a wall hanging to removably store child's toys thereon. The wall hanging is formed in the configuration of a tree, is of flat masonite and fixedly carries hook patches of VELCRO material which are releasably engaged by corresponding loop patches of material affixed to the back surfaces of such toys to removably store sayd toys on said wall hanging.

1 Claim, 2 Drawing Figures

TOY DISPLAY WALL HANGING

BACKGROUND OF THE INVENTION

1. Technical Field

This invention pertains to a toy display wall hanging which permits a child's toys to be organized and removably stored thereon. Inclusively, the wall hanging functions as an educational device in stimulating the child's mind towards neatness and creativity, and thereby inculcate good work habits of neatness and organization. Inasmuch as the wall hanging can take various forms, such as the pleasing aspect of a tree, the wall hanging contributes an esthetic value to the child's room.

2. Background

Children, unless they have been inculcated with good work habits of neatness and organization, after playing with their toys, leave their toys scattered around their room, thus, presenting a hazardous condition such as for one to trip over such scattered toys. To eliminate this problem, parents have devised various storage means such as a toy box, drawer or closet-drawer. However, such type of storage is often inadequate and insufficient with the result that the toys are crushed and damaged at times when same are stuffed together helter-skelter fashion.

SUMMARY OF THE INVENTION

Accordingly, the object of this invention is to provide a toy display wall hanging in the configuration of a pleasing object such as a tree formed from a flat sheet of masonite or other suitable material and screen printed in a variety of colors. The wall hanging fixedly carries the hook portions of the material known as VELCRO. Suitable fastening means, such as screws, are employed to vertically dispose and mount the wall hanging in coplanar relationship on a wall of a child's room. The corresponding loop portions of the VELCRO material are sewn or glued upon the back surfaces of the toys, such as stuffed animals and dolls. Hence, the child's toys are removably stored on the wall hanging by simply engaging the loop portions of the toys with the hook portions of the patches thereon.

BRIEF DESCRIPTION OF THE DRAWINGS

This object and other objects of the invention should be discerned and appreciated by reference to the drawings, wherein like reference numerals refer to similar parts throughout the several views, in which.

DESCRIPTION OF THE PREFERRED EMBODIMENT

Figure 1:
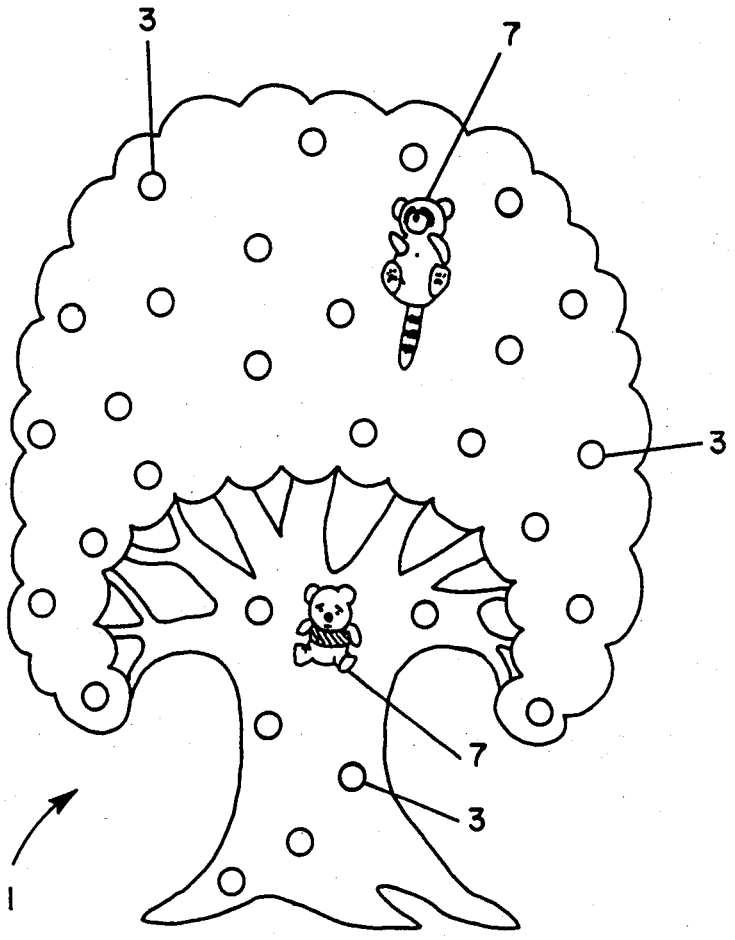
FIG. 1 is a front view of the wall hanging.
Figure 2:
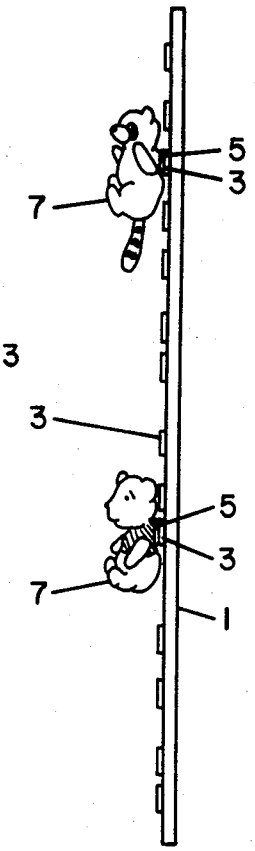
FIG. 2 is a side view of such wall hanging.

In FIG. 1 of the drawings, reference numeral 1 generally refers to the wall hanging shown in the configuration of a tree cut out or otherwise suitably formed from an original flat sheet of 4'×8' masonite or other suitable material. Suitable fastening means, not shown, such as screws, are employed to vertically dispose and mount the wall hanging 1 on the wall of a child's room. The wall hanging 1 can be screen-printed in a variety of colors to correspond to the colors of the tree trunk, leaves, etc. The wall hanging 1 fixedly carries the hook portions 3 of VELCRO patches such as by same being adhered, glued or otherwise suitably affixed thereto. Loop portions 5, corresponding to the hook portions 3, are fixed to the toys 7 by being sewn thereto or glued to the back surfaces of such toys 7.

The wall hanging 1 is utilized in organizing and removably storing a child's toys 7 by simply engaging the loop portions 5 of the toys 7 with appropriate hook portions 3 of the patches on the surface of wall hanging 1.

Having thusly described my invention, I claim:

1. In combination, a toy display wall hanging and toys such as animals and dolls removably and releasably stored neatly on said wall hanging, said wall hanging being a flat sheet of MASONITE material for disposition and mounting in coplanar relationship on a wall of a child's room, said wall hanging being in the configuration of a pleasing object such as a tree, said object being screen-printed in a variety of colors corresponding to the colors of the tree trunk, branches and leaves, said object fixedly carrying hook portions of VELCRO patches, said toys having back surfaces, said back surfaces carrying in fixed relationship therewith loop portions of VELCRO patches corresponding in size with said hook portions, said hook portions of the said VELCRO patches carried by said tree having characteristics for engaging said loop portions of said VELCRO patches carried by said back surfaces of said toys to thereby removably and releasably secure and store said toys neatly on said wall hanging.

* * * * *